US007991175B2

(12) United States Patent
Nielsen et al.

(10) Patent No.: US 7,991,175 B2
(45) Date of Patent: Aug. 2, 2011

(54) METHOD AND A SYSTEM TO ADJUST THE ACOUSTICAL PERFORMANCE OF A LOUDSPEAKER

(75) Inventors: Kaj Nielsen, Thyholm (DK); Ole Jensen, Skive (DK)

(73) Assignee: Bang & Olufsen A/S, Struer (DK)

( * ) Notice: Subject to any disclaimer, the term of this patent is extended or adjusted under 35 U.S.C. 154(b) by 318 days.

(21) Appl. No.: 12/287,144

(22) Filed: Oct. 6, 2008

(65) Prior Publication Data

US 2010/0086162 A1 Apr. 8, 2010

(51) Int. Cl.

| | |
|---|---|
| ***H04R 1/02*** | (2006.01) |
| ***H04R 9/06*** | (2006.01) |
| ***H04R 1/20*** | (2006.01) |
| ***H04R 9/08*** | (2006.01) |

(52) U.S. Cl. ..... 381/333; 381/332; 381/387

(58) Field of Classification Search ..... 381/333, 381/332, 387

See application file for complete search history.

(56) References Cited

U.S. PATENT DOCUMENTS

| | | | | |
|---|---|---|---|---|
| 2005/0105744 | A1* | 5/2005 | Lee | 381/86 |
| 2008/0170729 | A1* | 7/2008 | Lissaman et al. | 381/303 |
| 2008/0199037 | A1* | 8/2008 | Xu et al. | 381/387 |
| 2008/0219458 | A1* | 9/2008 | Brooks et al. | 381/57 |

FOREIGN PATENT DOCUMENTS

| | | |
|---|---|---|
| FR | 2562370 | 3/1984 |
| JP | 57116495 | 7/1982 |
| JP | 58170195 | 10/1983 |
| JP | 58218294 | 12/1983 |
| JP | 09093690 | 4/1997 |
| KR | 10-2005-0018415 | 2/2005 |
| WO | WO 2005/081520 | 9/2005 |

* cited by examiner

*Primary Examiner* — Haresh N Patel

(74) *Attorney, Agent, or Firm* — James Creighton Wray

(57) ABSTRACT

The invention relates to a method and a system for optimizing the performance of a loudspeaker system as perceived by user.

The physical part of the speaker system is adjustable which enables the speaker units to be placed in positions that imply maximal acoustical performance. This is obtained by combined means to: 1) bring the speaker in a specified position and 2) apply accordingly position dependant individual acoustical filters inserted in the signal path to each individual speaker.

16 Claims, 3 Drawing Sheets

METHOD AND A SYSTEM TO ADJUST THE ACOUSTICAL PERFORMANCE OF A LOUDSPEAKER

FIELD OF THE INVENTION

The present invention relates to improvements in sound experience as perceived by the user in a listening room. Specifically—but not exclusively the means to obtain the increased performance is by adjusting the speaker position according to the listening position of the user and accordingly adjust individual filter means in the signal path to the loudspeaker.

BACKGROUND OF THE INVENTION

When a loudspeaker is placed within an enclosed space the timbre of the loudspeaker as perceived by a listener is highly affected by the acoustical properties of the space.

Traditionally built-in loudspeaker in walls, ceiling's and floors has a very poor performance due to the difficult radiation properties out from the speaker units.

The designer of the sound reproduction system usually wishes to give the listener the same intended listening experience regardless of the acoustical properties of the listening space.

Attempts of providing systems which addresses this desire has been suggested in the art, see for example JP58218294, JP58170195 and JP57116495.

From JP58218294 is known a system where the mid and high range speaker units are arranged in a convex rotatable member relative to the loudspeakers surface. By rotating the member, the sound emitting angle due to the convex shape of the member from the mid and high range speakers, relative to the speaker's surface may be altered, in order to improve the overall sound emission.

In JP58170195 is disclosed a system where the loudspeaker type may be changed by rotating a member. The mid and high range loudspeaker units are mounted in the rotatable member. Furthermore by rotating the member a bus reflex port may be opened or closed in the front surface of the loudspeaker, thereby changing the properties of the loudspeaker.

Finally in JP57116495, the tweeter speaker unit of a loudspeaker construction, has been mounted such that it may tilt relative to a woofer speaker. In this manner it is possible to adjust the tweeters emission relative to the woofers emission, simply by directing the tweeters sound emission in a different direction.

With the current invention the loudspeaker system may adapt dynamically to the listeners position in a room.

Thus the object of the invention is to provide a loudspeaker system concept with dynamic properties such that not only the sound properties are optimised but also the listeners position is taken into account such that it is possible to create an optimum listening experience for the listener regardless of the listeners position in the room.

This object is achieved by a speaker system according to independent claim 1.

In further embodiments according to the dependent claims further advantageous objects are achieved, for example by:

- Including one or more speaker units,
- the speaker units are mounted into a frame that is rotate able and tilt able,
- individual filters may be adapted according to the individual speaker positions,

- positioning the speakers according to the listener position may be user commanded and/or automatically controlled, and
- active loudspeakers are applied for efficiency.

DESCRIPTION OF THE INVENTION

In the following, preferred embodiments of the invention will be described with reference to the drawing wherein FIG. 1 illustrates a top view of the invention with the speaker units in the default position.

FIG. 2*a* & *b* illustrates a top view of the invention with the speaker units in two different positions.

FIG. 2*c* & *d* illustrates a side view of the invention with the speaker units in two different positions.

Figure 1:
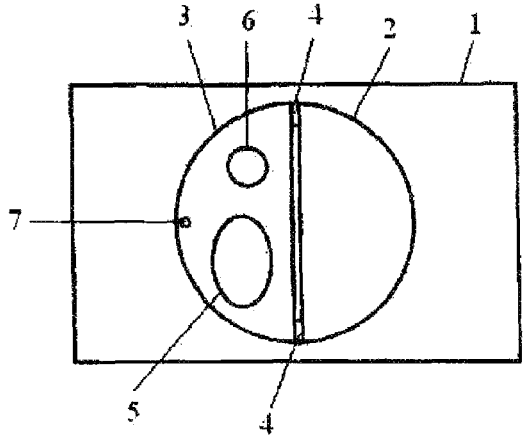

In a first aspect, the invention relates to:

A speaker system, where the speaker units mounted in the speaker system may be configured into different positions to increase the acoustical performance perceived by the user, where said speaker system contains a mechanical structure consisting of four members:

- a first member(1), where said first member may have any geometrical shape, where said member has a first surface and defining a circular innermost periphery of said first member;
- a second member(2), where said second member may be arranged within the circular periphery provided on the first member(1), such that the second member may be rotate able around an axis perpendicular to, or close to being perpendicular to, the plane of the surface of the first member(1), and with the second member(2) fully or partly having a material surface;
- a third member(3) being an integrated part of the second member(2) or being a separate object mounted on top of the second member(2), and where said third member (3) includes one or more speaker units(5,6) mounted to deliver acoustical output directed away from the surface of the third member (3);
- a fourth member (4), where said fourth member is support structure including a hinge for the third member (3) and enables the third member(3) to be tilt able around an axis horizontal to, or close to being horizontal to, the plane of the surface of the second member(2) and with the fourth member (4) attached to the second member(2).

In a preferred embodiment the motorized means (31, 32, 33) control the position of the loudspeaker units (5, 6) in the speaker system. The motor means controls the rotating of the second member (2) and controls the tilting of the third member (3).

Standard means are applied to control the motors and to determine the position of each motor relative to a polar coordinate system for each of the movements, i.e. the rotation(8) of the second object(2) and the tilt(9) of the third object (3).

In one aspect the required position of the speakers are obtained by passing information of the X, Y coordinates related to the rotation of the second member to the second member motor means and by passing information of the X, Y coordinates related to the tilting of the third member to the third member motor means.

A predefined set of X, Y parameters for each of the motor means may be applied as the initial setting of the second- and third members upon start up of the speaker system. The same set of parameters may be applied as a default position that may be returned to during operation, thus to act as a Reset position for the loudspeakers.

In another aspect the rotation and the tilting of the loudspeaker units may be controlled by the user via a command from a wireless control device. Standard means (e.g. Infrared, Radio Frequency, Bluetooth or alike) may be applied for the communication from/to the remote terminal.

Specific X, Y coordinate values may be transferred to the speaker system and/or relative commands like: 'rotate left; rotate right; tilt up; tilt down; reset or similar commands.

Other functional related commands like 'bigger'; 'smaller'; 'light'; 'heavy' may be sent from a remote device for further mapping into specific X, Y parameter by the speaker system.

In the preferred embodiment this flexible addressing speaker units positions are that:

- the X, Y coordinates of the second member position may be forced to given values, and thus forced to a given position of the speaker, specified from an external control device, and
- the X, Y coordinates of the third member position may be forced to given values, and thus forced to a given position of the speaker, specified from an external control device.

In yet another aspect the position of the speaker units of one speaker system may automatically be oriented towards a detected location of a source signal in a room. This room location may be the listing position. Standard means are applied to generate the source signal; e.g. an infrared signal from a control device may be applied, and issued from the device upon a user command. The speaker system has a built in infrared receiver and detects the infrared beam. In a sequential flow of operation each of the motor means, i.e. the rotation motor means and the tilt motor means, are positioned from their respective min. to the max. positions in combinations to detect the maximum of the received IR signal.

Alternatively to the IR signal and—detection method, an RF signal and—detection method or a sound signal and—detection method may be applied.

In the preferred embodiment these automated speaker units positions are where: the position of the second member and the position of the third member are determined from a detected maximum and or a detected minimum in a signal beam issued from a source located in the listening position of the user towards the speaker system.

In yet another aspect individual correction filters are applied in the signal path of every speaker according to the orientation/position of the speaker; this to maximize the sound quality as perceived by the listener. A predefined set of filter attributes are available for a set of defined X, Y positions related rotation and related to tilting of the loudspeaker units.

In the preferred embodiment these correction filter attributes may be used dynamically and consists of:

- a predefined set of filter attributes are applied as the default correction filters to be in the signal path for each of the one or more speakers, and
- a predefined plurality of individual set of filter attributes are related to different speaker positions for each of the one or more speakers, and
- a predefined set of filter attributes are selected and applied as the actual correction filter to be in the signal path for each of the one or more speakers, where the set of filter attributes are selected based on the X,Y position of the speaker.
- a predefined plurality of individual set of filter attributes related to speaker positions for each of the one or more speakers may be replaced with data from an external source.

In the preferred embodiment these correction filter attributes are related to the X, Y position of the rotation means and to the X, Y position of the tilt means in a simple index table in a discrete manner:

If X, Y position is in the interval pos1→pos2 Then apply filter set1

| Rotate position | Tilt position | Filter | Index |
|---|---|---|---|
| Rpos1 -> Rpos2 | Tpos1 -> Tpos2 | Fset1 | 1 |
| | Tpos2 -> Tpos3 | Fset2 | 2 |
| | +++ | +++ | // |
| | TposN-> TposM | FsetN | N |
| Rpos2 -> Rpos3 | Tpos1 -> Tpos2 | Fset1.1 | N + 1 |
| | Tpos2 -> Tpos3 | Fset2.1 | N + 2 |
| | +++ | +++ | // |
| | TposN-> TposM | FsetN.1 | N + N |
| | | | // |
| Rpos3 -> Rpos4 | Tpos1 -> Tpos2 | Fset1.2 | 2N + 1 |
| | Tpos2 -> Tpos3 | Fset2.2 | 2N + 2 |
| | +++ | +++ | // |
| | TposN-> TposM | FsetN.2 | // |
| +++ | | | |
| RposP -> RposQ | Tpos1 -> Tpos2 | Fset1.p | // |
| | Tpos2 -> Tpos3 | Fset2.p | // |
| | +++ | +++ | // |
| | TposN-> TposM | FsetN.p | // |

The table above illustrates the mapping of positions into filter index:

- a predefined plurality of individual set of X, Y coordinates are related to the second member position and where a predefined plurality of individual set of other X, Y coordinates are related to the third member position and where an index is related to a set of corresponding filter attributes that applies in that specific speaker position, and
- a predefined plurality of individual set of X, Y coordinates are related to the second member position and where a predefined plurality of individual set of other X, Y coordinates are related to the third member position and where an index is related to a set of corresponding filter attributes that applies in that specific speaker position and where the complete set of definitions may be replaced with data from an external source.

In FIG. 1 the invention is displayed with the main elements:

The basic structure as a first element (1) may act as the fixture of other parts of the construction. The outer shape of this element is primarily determined by the requirement set up for the end user product, into which the invention will be a part of.

A circular cavity in the first element is the room for the second (2) and the third (3) elements. Those elements are mounted so they have the freedom to rotate. According to requirements the allowed rotation may be whatever subset of the full rotation capability of 0→360 deg. Preferable the axis of rotation is perpendicular to the surface of the first element(1).

The third element (3) is attached to the rotational part of the construction (2) via a hinge (4) or alike, that allows the third member (3) to tilt. According to requirements the allowed tilting may be whatever subset of the full movement capability of 0→90 deg. Preferable the axis of tilting is parallel to the surface of the second element (2).

The loudspeaker units (5, 6) are mounted into the third element (3) such that the acoustical output is radiated away from the surface of the third element.

One or more speaker units may be implemented according to product requirements. In a preferred embodiment two speakers are applied: one for high frequency sound radiation and one for medium frequency sound radiation.

As part of the subsystem that detects a listening position (37) the detector of an infrared receiver (7) may be integrated into the surface of the third element. Alternative means may be implemented applying RF- or sound signal technologies.

Figure 2:
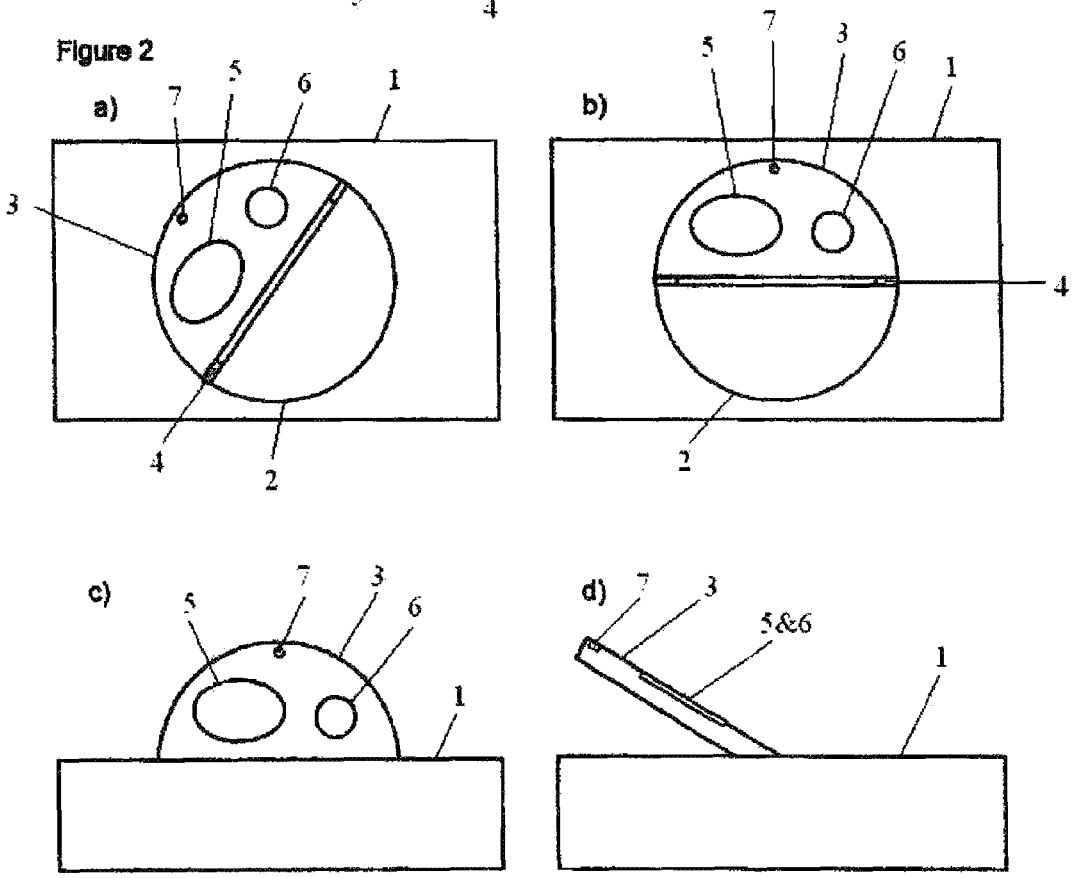

FIG. 2 illustrates different positions of the third element. The positions are examples of how the loudspeaker speaker units (5, 6) may be oriented towards a specific position in a listening room:

In FIG. 2.*a* the second—and third element is rotated approximately—45 deg. relative to the initial position in FIG. 1.

In FIG. 2.*b* the second—and third element is rotated approximately—90 deg. relative to the initial position in FIG. 1.

In FIG. 2.*c* the second—and third element is rotated approximately—90 deg. relative to the initial position in FIG. 1.

In FIG. 2.*d* the second—and third element is rotated approximately—90 deg., and the third element is tilted approximately—45 deg. relative to the initial position in FIG. 1.

Figure 3:
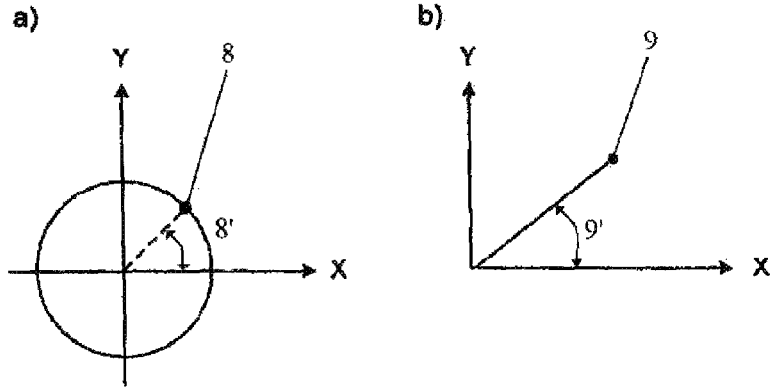
FIG. 3 illustrates the coordinate systems related to rotation- and tilt positions.

FIG. 3 illustrates how ordinary X, Y coordinate systems defined the position of the speaker units (5, 6). A specific position may be defined by X,Y coordinates (8, 9) or an angle relative to the x-axis (8', 9'):

FIG. 3.*a* display an example of the rotation of the second—and third element into a position (8).

FIG. 3.*b* display an example of the tilting of the third element into a position (9).

Figure 4:
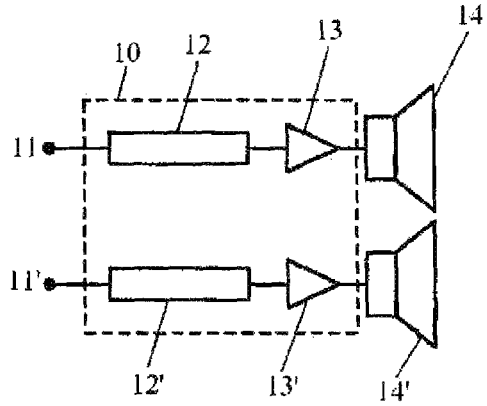
FIG. 4 illustrates the signal path including filters, amplifiers and two speaker units.

FIG. 4 illustrates how one of more speaker units is configured:

Compensation filters (12, 12') are inserted into the signal path (11, 11'). The parameters determining the characteristics of a filter may be replaced dynamically according to an actual position of the speaker units. Individual filters are applied per speaker unit (14, 14').

Individual amplifiers (13, 13') are applied per speaker unit (14, 14'). Active speakers may be applied. For efficiency reasons, i.e. to optimize physical size and power consumption versus output power performance, a technology like ICEpower from Bang & Olufsen may be used.

Typical applications of the speaker system as outlined may be into a stand alone loudspeaker or to be applied as an in-wall loudspeaker, or as an in-ceiling loudspeaker or as an in-floor loudspeaker, or as a loudspeaker in a home appliance and in media systems.

Figure 5:
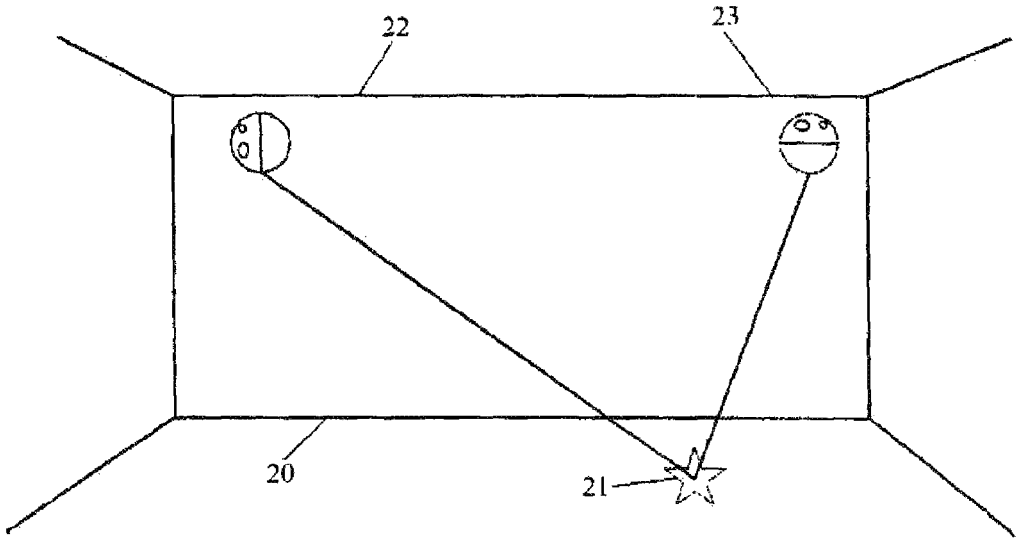
FIG. 5 illustrates how to set of speaker systems adjust according to the listing position in a room.

In FIG. 5 it is illustrated how two in-wall speaker systems (22, 23) are located in a room (20). One of the loudspeaker systems (22) is vertically aligned towards the listening position (21) and the other of the loudspeaker systems (23) is horizontally aligned towards the listening position (21).

In a room with a plurality of loudspeaker systems according to the invention, the filters to be applied dynamically per loud speaker unit in all systems may be configured according to different methods based on:

Positions commanded externally from a user remote control device (36).

A detected listener position, as deduced from an incoming source signal beam, e.g. an infrared signal (37).

A detected position of other loudspeakers in the room, as deduced from an incoming sound signal received by the actual speaker system, e.g. a sound signal issued by another speaker unit in the room and received via a microphone (34') by the actual speaker system.

Figure 6:
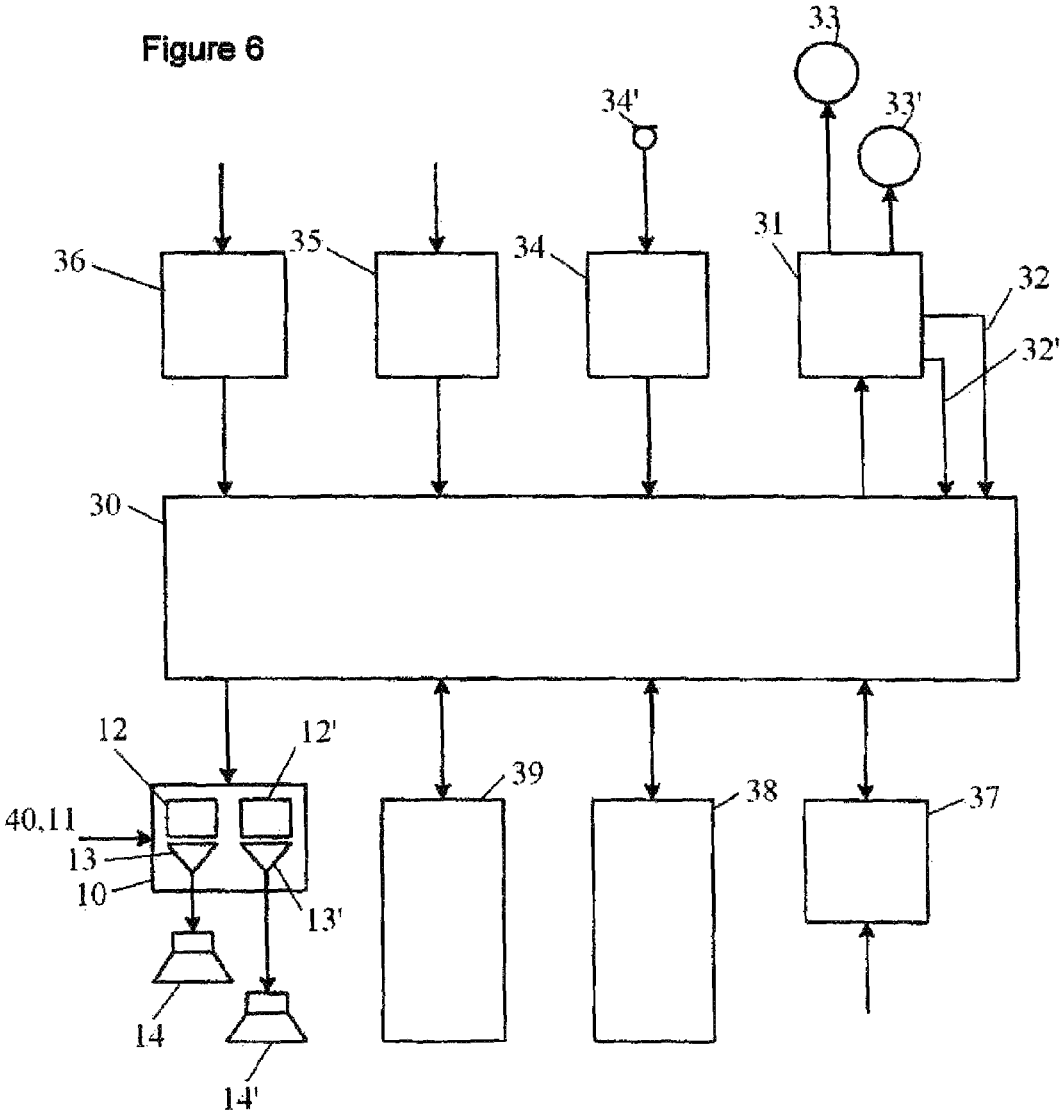
FIG. 6 illustrates the control system of the invention.

FIG. 6 display the controller (30) of the loudspeaker system of one embodiment according to the invention:

The sound signal (40, 11) is via the filters (12, 12') and the amplifiers connected to the loud speaker units (14, 14').

The dynamic load and reload of the filter attributes is supported by data sourced in a table (39).

The support of the filter management that is related to actual X,Y positions of the speaker units is supported by data sourced in a table (38).

Archived filter attributes may be updated or modified by a reload of new data from an external source (35). The load may via a wired data link or via a wireless data link and sourced e.g. from a PC.

A subsystem (37) supports the detection of the listening position by detecting the maximum of an incoming source signal e.g. infra red light beam. The system detects the maximum by analyzing different combinations of the rotation position and the tilt position.

A subsystem (34) supports the detection of position of other loudspeakers in the room, as deduced from an incoming sound signal received via a microphone (34') by the actual speaker system.

A subsystem (31) controls the motor that supports the rotational movement (33) and the tilt movement (33'). Standard means are applied for the control and the position of each of the motors, one to detect the X,Y position of the rotation (32) and one to detect the X,Y position of the tilt (32').

The invention claimed is:

1. A speaker system, comprising speaker units mounted in the speaker system, wherein the speaker units are configured into different positions to increase acoustical performance perceived by a user, wherein said speaker system further comprises contains a mechanical structure comprising four members:

a first member, wherein said first member has any geometrical shape, wherein said first member has a first surface and defining a circular innermost periphery of said first member;

a second member, wherein said second member is arranged within the circular periphery provided on the first member, such that the second member is rotatable around an axis perpendicular to, or close to being perpendicular to, a plane of the first surface of the first member, and with the second member fully or partly having a material surface;

a third member being an integrated part of the second member or being a separate object mounted on top of the second member, and wherein said third member includes one or more of the speaker units mounted to deliver acoustical output directed away from a surface of the third member;

a fourth member, wherein said fourth member further comprises support structure including a hinge for the third member, and the hinge enables the third member to be tiltable around an axis horizontal to, or close to being horizontal to, a plane of a surface of a second member and with the fourth member attached to the second member, wherein the speaker system further comprises at least one correction filter provided in a signal path of the speaker unit, said at least one correction filter being configured to filter outputs of said speaker units based on a series of filter attributes, wherein a set of said filter attributes are selected based on the positions of the speaker units, and wherein a predefined plurality of individual set of filter attributes related to speaker unit positions for each of the one or more speaker units are replaced with data from an external source.

2. The speaker system according to claim 1, further comprising motors adapted to control the rotating of the second member and tilting of the third member.

3. The speaker system according to claim 2, wherein positions of the speakers units are obtained by passing information of X, Y coordinates related to the rotation of a second member to the second member motor and by passing information of X, Y coordinates related to the tilting of the third member by a member motor.

4. The speaker system according to claim 3, wherein a predefined set of filter attributes are applied as default correction filters in a signal path for each of the one or more speakers units.

5. The speaker system according to claim 4, wherein one of a predefined set of X, Y coordinates defines an initial position of the second member.

6. The speaker system according to claim 4, wherein one of a predefined set of X, Y coordinates-defines an initial position of the third member.

7. The speaker system according to claim 6, wherein X, Y coordinates of a position of the second member are forced to given values, and thus are forced to a given positions of the speaker units, specified from an external control device.

8. The speaker system according to claim 6, wherein X, Y coordinates of a position of the third member are forced to given values, and thus are forced to a given position of the speaker units, specified from an external control device.

9. The speaker system according to claim 8, wherein a predefined plurality of individual sets of X, Y coordinates related to the second member position and where a predefined plurality of individual sets of other X, Y coordinates are related to the third member position and where an index is related to sets of corresponding filter attributes that apply in specific speaker unit positions.

10. The speaker system according to claim 8, wherein a predefined plurality of individual sets of X, Y coordinates related to the second member positions and where a predefined plurality of individual sets of other X, Y coordinates are related to the third member positions and where an index is related to a set of corresponding filter attributes that applies in that specific speaker unit positions and where the sets are replaced with data from an external source.

11. The speaker system according to claim 1, wherein, a position of the second member and a position of the third member from a detected maximum and or a detected minimum in a signal beam issued from a source located in a listening position of a user towards the speaker system.

12. The speaker system according to claim 1, wherein a predefined plurality of individual sets of filter attributes are related to different speaker positions for each of the one or more speakers.

13. The speaker system according to claim 1, wherein a predefined set of filter attributes are selected and applied as an actual correction filter in a signal path for each of the one or more speaker units, where the set of filter attributes are selected based on the X,Y positions of the speaker units.

14. A speaker system according to claim 1, wherein the speaker units and the mechanical structure form a stand alone loudspeaker.

15. A speaker system according to claim 1, wherein the speaker units and mechanical structure form a built in loudspeaker, to be applied as an in-wall loudspeaker, and/or as in-ceiling loudspeaker and/or as an in-floor loudspeaker.

16. A speaker system according to claim 1, wherein the speaker units and the mechanical structure form a loudspeaker in a home appliance and/or in media systems.

* * * * *